US005154413A

United States Patent [19]

Boughton et al.

[11] Patent Number: 5,154,413

[45] Date of Patent: Oct. 13, 1992

[54] ACCESSING GUIDE FOR INSERTER FEED PATH

[75] Inventors: Richard D. Boughton, Bethel; Joan T. Wagner, Fairfield; Kenneth A. Schulz, Bethel; Robert D. Lynch, Jr., Oxford; Joseph H. Marzullo, Brookfield, all of Conn.

[73] Assignee: Pitney Bowes Inc., Stamford, Conn.

[21] Appl. No.: 756,662

[22] Filed: Sep. 9, 1991

[51] Int. Cl.[5] ..... B65H 9/16

[52] U.S. Cl. ..... 271/248; 271/253; 271/226

[58] Field of Search ..... 271/223, 226, 234, 236, 271/238, 240, 248, 253, 171

[56] References Cited

U.S. PATENT DOCUMENTS 3,807,725 4/1974 Bookless ..... 271/171

FOREIGN PATENT DOCUMENTS 0107346 7/1982 Japan ..... 271/248
0075745 4/1986 Japan ..... 271/248
0226652 9/1989 Japan ..... 271/171

*Primary Examiner*—H. Grant Skaggs
*Assistant Examiner*—Carol Lynn Druzbick
*Attorney, Agent, or Firm*—Charles R. Malandra, Jr.; Melvin J. Scolnick

[57] ABSTRACT

An accessing guide in combination with the paper path of a deck for transporting paper documents. The combination includes: a deck for supporting and transporting paper documents seriatim; and an adjustable side guide mounted on the deck for movement perpendicular to the direction of the paper path for guiding the flow of documents along the deck. The guide has a pivotable rail which can pivot away from the paper path in order to allow access to the paper path by an operator.

5 Claims, 3 Drawing Sheets

Fig. 5.
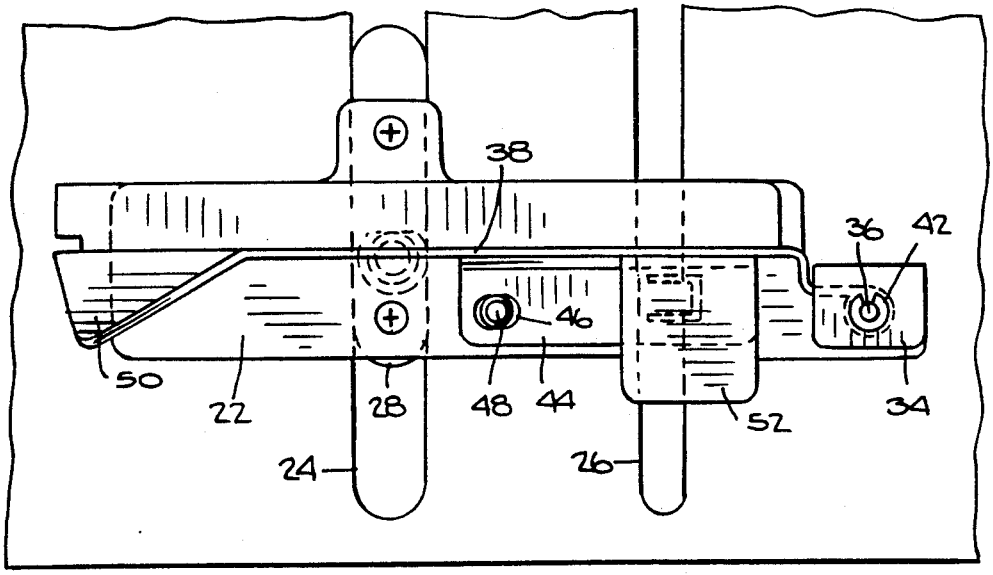
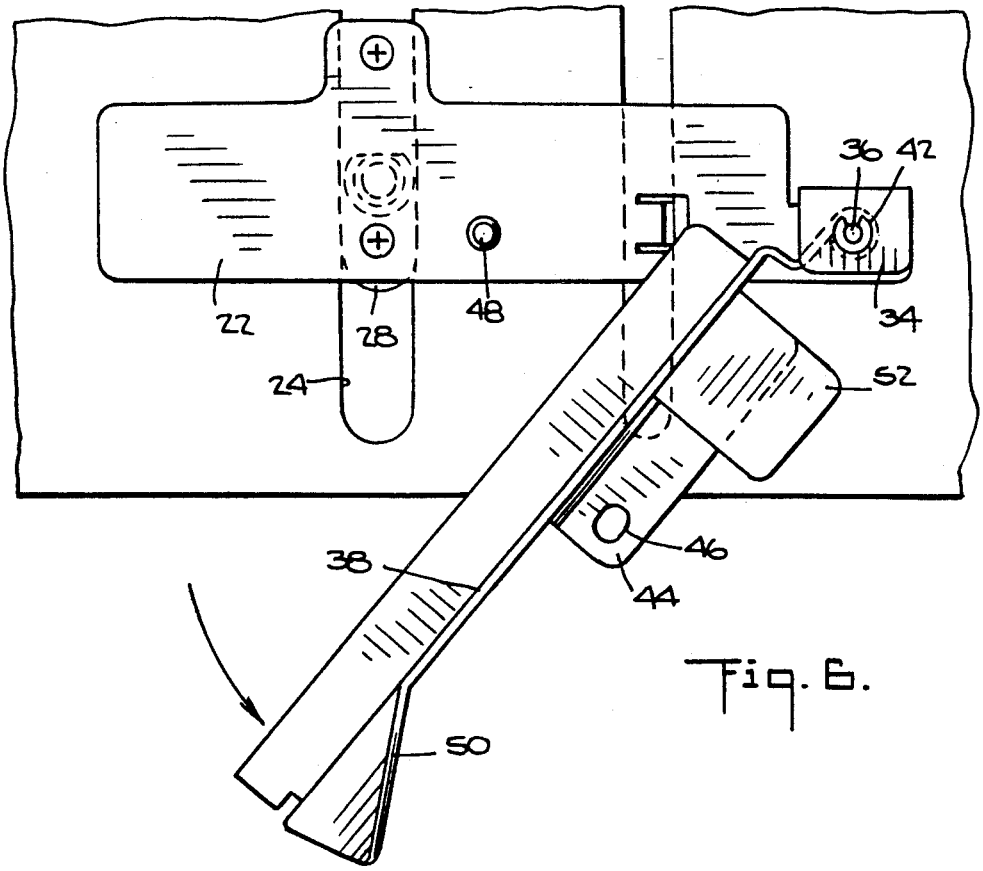
Fig. 6.

ACCESSING GUIDE FOR INSERTER FEED PATH

BACKGROUND OF THE INVENTION

The present invention relates to an envelope inserting machine for processing varying sizes of insert material which is loaded by a machine operator into a plurality of feeders in the inserter, and more particularly to the side guides employed on the transport deck of the inserting machine.

The scope of an envelope inserting machine is such that a wide range of sizes of sheets, documents, tabulating cards or other enclosure material is processed and deposited into envelopes which are registered and appropriately positioned on the output end of the machine. The typical envelope inserting machine has a frame for supporting the plurality of feeders in an aligned row. Each feeder is programmed to deliver one or more documents by a predetermined method which utilizes a signaling device such as a printed code on a master enclosure document. In this way, the feeders deliver sequential enclosures to a continuous conveyor, which in turn pushes the individual or stacked enclosures along a path leading to an appropriate waiting envelope located downstream at an inserting station.

It is along the conveying path that the enclosures are transported where document jams and lateral misguiding of the enclosures frequently occur and which in turn results in decreased effectiveness of the through-put capability of the inserting machine due to machine down time and increased operator maintenance.

One of the most difficult locations to remove jams from is the queuing station, where documents are stopped prior to further processing, such as insertion into an envelope, or combining with other documents from a downstream feeder.

Document side guides are typically employed in the queuing areas to maintain side alignment of the documents as they are being fed. The guides are set at a particular spacing dependent upon the size of the documents being fed. When a jam occurs, typically the guides are temporarily removed from their setting, and then re-set once the jam is cleared. Obviously, the re-setting is time consuming and there is inherent in the re-setting process the possibility that the new setting will not be identical to the old setting. Accordingly, the instant invention overcomes these prior art problems by providing side guides for an inserter feed path which provide rapid access to the feeding area and do not require re-setting by an operator of the inserter.

SUMMARY OF THE INVENTION

The instant invention provides an accessing guide in combination with the paper path of a deck for transporting paper documents. The combination includes: a deck for supporting and transporting paper documents seriatim; and an adjustable side guide mounted on the deck for movement perpendicular to the direction of the paper path for guiding the flow of documents along the deck. The guide has a pivotable rail which can pivot away from the paper path in order to allow access to the paper path by an operator.

BRIEF DESCRIPTION OF THE DRAWINGS

FIG. 5 is a top, plan view of the side guide seen in FIG. 1 in the operational position;

FIG. 6 is the same as FIG. 5 except the side guide is swung open to provide access to the feed path.

DETAILED DESCRIPTION OF THE PREFERRED EMBODIMENT

Figure 1:
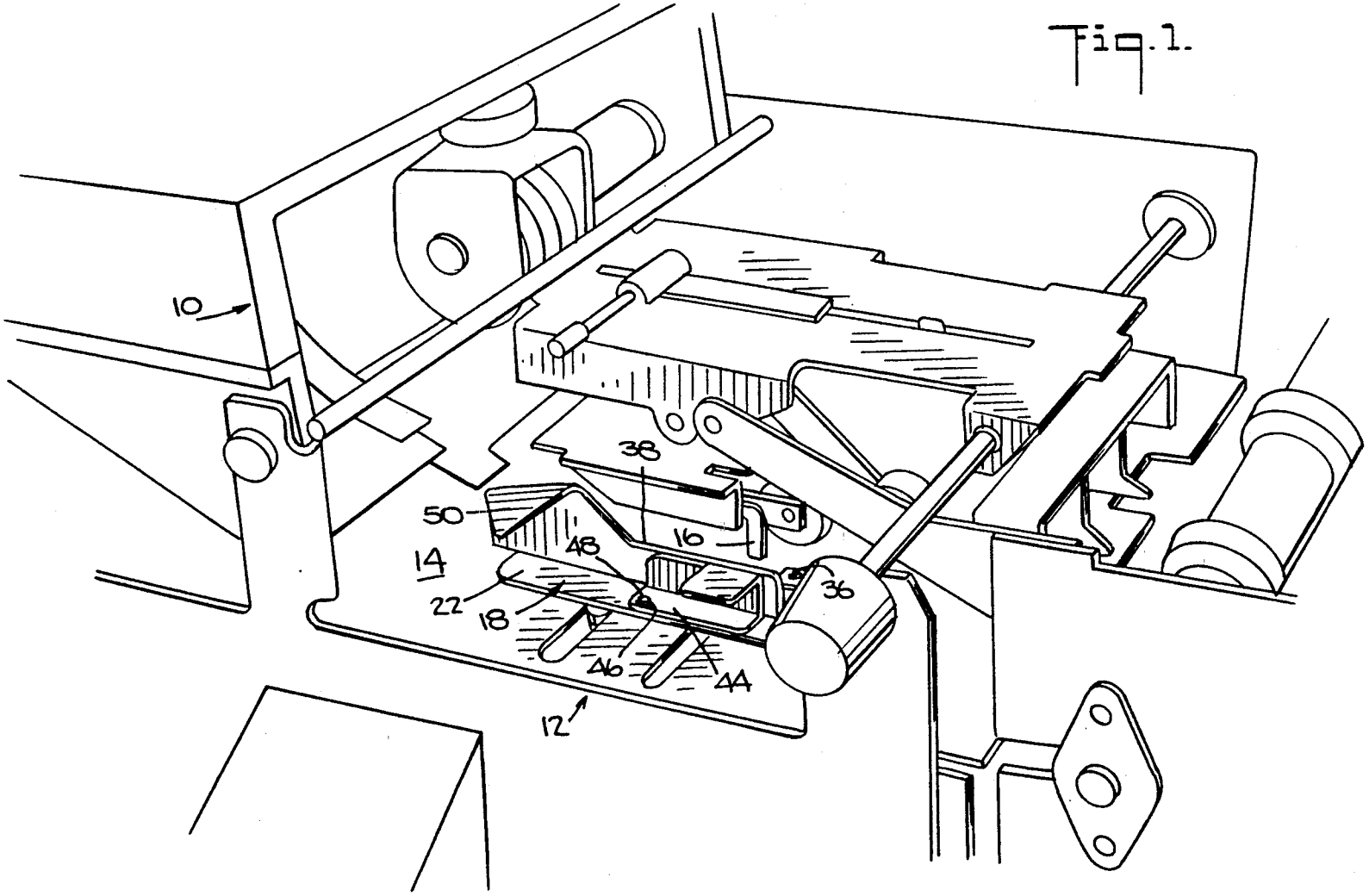
FIG. 1 is a perspective view of the feed path of an inserting machine utilizing document side guides in accordance with the instant invention.
Figure 2:
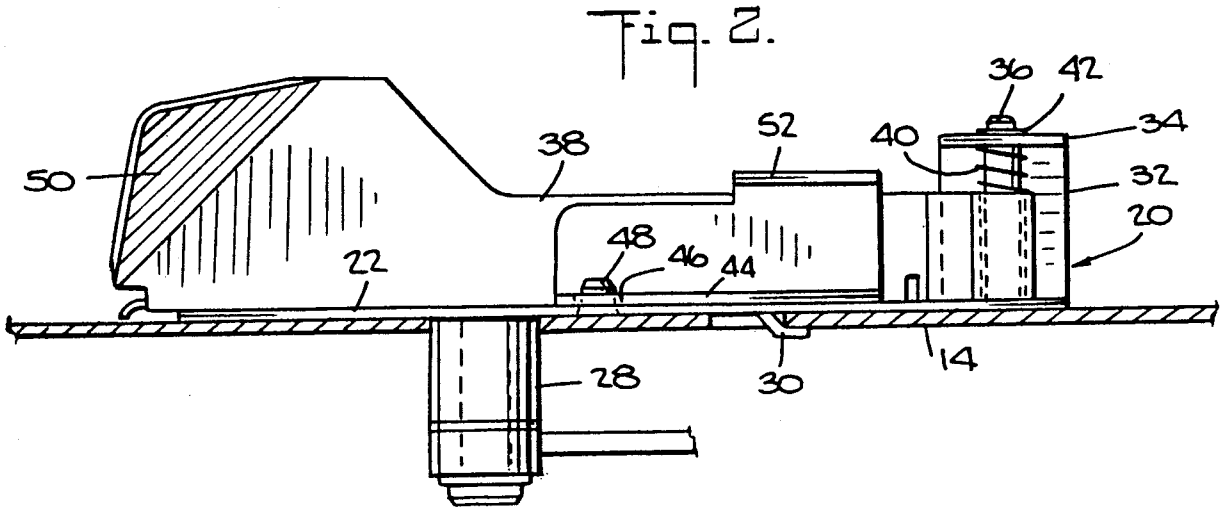
FIG. 2 is a side, elevational view of the side guide seen in FIG. 1 in the operational position.

In describing the preferred embodiment of the instant invention, reference is made to the drawings, wherein there is seen a document feeder 10 for feeding documents (not shown) to a queuing station 12 where the documents are collected and aligned prior to being fed downstream toward another document feeder or an inserting station and further processing.

The queuing station 12 includes a deck 14 for receiving the documents and a plurality of belts and rollers for feeding the documents through the queuing station 12. At the downstream end of the queuing station 12 are a pair of registration stops 16 which stop the documents on the deck 14 and align the documents preparatory to further feeding and processing.

On both sides of the deck 14 are situated a pair of adjustable side guides 18 for guiding the flow of documents through the queuing station 12. Each side guide 18 includes a bracket 20 having a base 22 which can slide over the deck 14 as explained hereinbelow.

The deck 14 includes a pair of channels 24 and 26 oriented perpendicular to the direction of the feed paths. Depending from the bottom of the side guide base 22 is a slidable columnar member 28 which slidingly engages the channel 24 and an obtuse leg 30 which slidingly engages the channel 26 and the underside of the deck 14. The bracket 20 includes a vertical wall 32 and a horizontal wall 34 extending from the top of the vertical wall 32. The horizontal wall 34 and base 22 have apertures therein for receiving a pin 36 around which is mounted a pivotable rail 38 which is biased downwardly toward the deck 14 by a spring 40. The pin 36 is held in place by a grip ring 42.

The rail 38 includes a lower, horizontal flange 44 having an aperture 46 for receiving a vertically extending stud 48 projecting upward from the base 22. The left (upstream) side of the rail 38 includes an angled, flange portion 50 which can be grabbed by an operator as explained further hereinbelow. The rail 38 also includes an upper, horizontal flange 52 which can be grabbed by an operator in order to move the outer side guide 18 in the-channels 24 and 26 to thereby adjust the side guide 18 to the proper width for the documents being fed along the deck 14.

Figure 4:
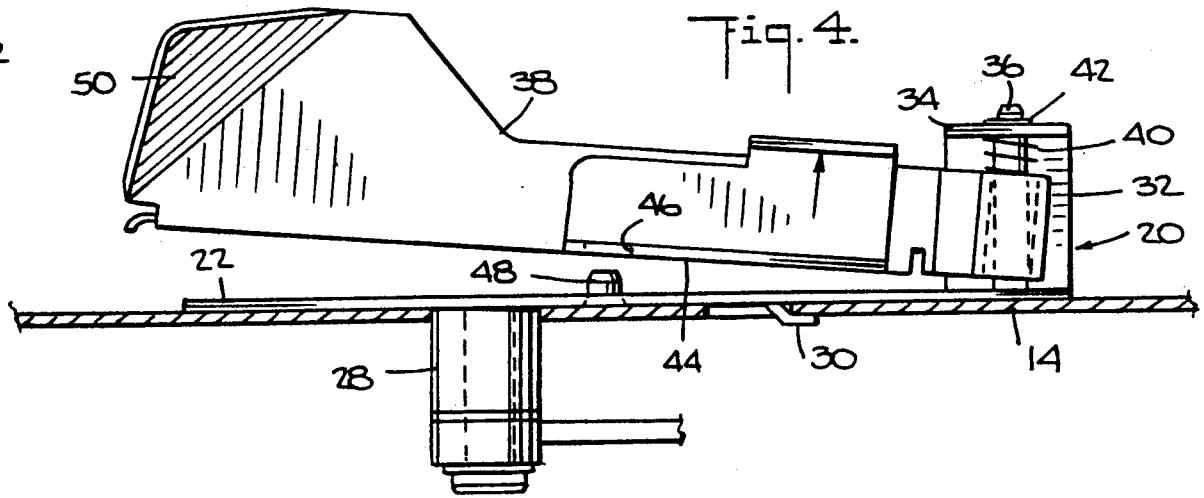
FIG. 4 is the same as FIG. 2 except that the side guide is lifted preparatory to being pivoted away from the feed path.
Figure 3:
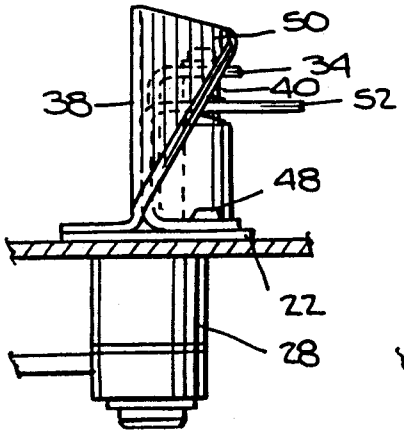
FIG. 3 is a side, elevational view of the latching mechanism of the side guide when the side guide is pivoted away from the feed path.

In operation, when a jam occurs on the deck 14 of the queuing station 12, the operator simply grips the flange portion 50 of the rail 38 and lifts the flange 50 up (see FIG. 4) and back away (see FIG. 6) from the deck 14. This lifting action is possible because the rail 38 is biased downwardly by the spring 40 and thus can be lifted upwardly. The upward motion of the rail 38 allows the rail 38 to clear the anchoring stud 48 and be pivoted away from the deck 14.

Once the jam is cleared, the operator simply reverses the foregoing process and seats the rail 38 on the anchoring stud 48, and the side guide 18 is automatically set in its original position without any further adjustment.

It should be understood by those skilled in the art that various modifications may be made in the present invention without departing from the spirit and scope thereof, as described in the specification and defined in the appended claims.

What is claimed is:

1. An accessing guide for the paper path of a deck for transporting paper document, comprising, in combination:

a deck for supporting and transporting paper documents seriatim; and an adjustable side guide mounted on said deck for movement perpendicular to the direction of said paper path for guiding the flow of documents along said deck, said guide having a movable rail which is pivotable between a document guiding position and a paper path access position, in order to allow access to said paper path by an operator.

2. An accessing guide for the paper path of a deck for transporting paper document, comprising, in combination:

a deck for supporting and transporting paper documents seriatim; and an adjustable side guide mounted on said deck for movement perpendicular to the direction of said paper path for guiding the flow of documents along said deck, said guide having a movable rail which is pivotable between a document guiding position and a paper path access position, in order to allow access to said paper path by an operator; said side guide additionally including a bracket having a base portion slidably engaging said deck, and a pin mounted in said base portion for mounting engagement with said pivotable rail.

3. The combination of claim 2, wherein said deck includes a channel oriented perpendicular tot he direction of said paper path, and said bracket base portion includes a slidable columnar member slidingly engaging said channel.

4. The combination of claim 3, wherein said base portion includes an upwardly projecting stud and said rail includes a horizontal flange having an aperture for receiving said stud.

5. The combination of claim 4, wherein said rail is biased downwardly about said pin.

* * * * *